US005168785A

United States Patent [19]

Yunoki

[11] Patent Number: 5,168,785

[45] Date of Patent: Dec. 8, 1992

[54] APPARATUS FOR SEVERING SLIDE FASTENER CHAIN HAVING FABRIC PIECES ATTACHED THERETO

[75] Inventor: Akio Yunoki, Namerikawa, Japan

[73] Assignee: Yoshida Kogyo K. K., Tokyo, Japan

[21] Appl. No.: 738,676

[22] Filed: Jul. 31, 1991

[30] Foreign Application Priority Data

Aug. 3, 1990 [JP] Japan ..... 2-206147

[51] Int. Cl.[5] ..... B26D 5/28

[52] U.S. Cl. ..... 83/210; 83/369; 83/371; 83/921; 29/766

[58] Field of Search ..... 83/921, 371, 369, 277, 83/209, 76.1, 210; 29/33.2, 408, 766

[56] References Cited

U.S. PATENT DOCUMENTS

| | | | |
|---|---|---|---|
| 3,776,078 | 12/1973 | Perlman | 83/371 |
| 4,300,283 | 11/1981 | Ueda | 29/766 |
| 4,594,925 | 6/1986 | Ishikawa | 83/921 X |
| 4,625,375 | 12/1986 | Yunoki | 29/33.2 |
| 4,771,522 | 9/1988 | Osaki | 29/33.2 |
| 4,989,851 | 2/1991 | Maede et al. | 83/921 X |
| 5,020,206 | 6/1991 | Yoshida et al. | 29/408 |

FOREIGN PATENT DOCUMENTS 48-42844 6/1973 Japan .

*Primary Examiner*—Frank T. Yost
*Assistant Examiner*—Rinaldi Rada
*Attorney, Agent, or Firm*—Hill, Van Santen, Steadman & Simpson

[57] ABSTRACT

An apparatus for automatically severing a slide fastener chain having a succession of fabric pieces attached to each of the opposed longitudinal marginal edges with a gap portion interposed between each adjacent pair of fabric pieces comprises a feeding unit; a cutting unit disposed on a feed path for severing the fabric-pieced slide fastener chain transversely across the gap portions; and detecting means for producing a signal only when laterally-aligned gap portions reach the detecting means. The detecting means, feeding unit and the cutting unit are electrically connected such that, upon receipt of the signal from the detecting means, the feeding unit is deenergized and at the same time the cutting unit is energized.

6 Claims, 7 Drawing Sheets

APPARATUS FOR SEVERING SLIDE FASTENER CHAIN HAVING FABRIC PIECES ATTACHED THERETO

BACKGROUND OF THE INVENTION

1. Field of the Invention

The present invention relates generally to an apparatus for severing a slide fastener chain, and more particularly to an apparatus for automatically severing a slide fastener chain having a succession of fabric pieces attached to each of the opposed longitudinal marginal edges thereof into a plurality of slide fasteners of an individual length.

2. Description of the Prior Art

According to the related art, it is customary to first sew a succession of fabric pieces such as trouser flies to a continuous length of a slide fastener chain along its one longitudinal marginal edge, with gap portions interposed between each adjacent pair of fabric pieces, while the continuous slide fastener chain is fed along a feed path; to detect such inter-fabric-piece gap by means of detecting means during the feeding of the fabric-pieced continuous slide fastener chain; and to finally, upon receipt of a signal generated by the detecting means, sever the continuous slide fastener chain laterally across the gap portions into a number of slide fasteners of an individual length each having a fabric piece attached to its one longitudinal marginal edge. This method and some apparatuses to carry out the method are disclosed in Japanese Patent laid-open publication No. 48-42844 and Japanese Patent Publication No. 1-44421. In this method, since only one succession of the fabric pieces are sewn to only one longitudinal marginal edge, mere cutting of the slide fastener chain across between each adjacent fabric pieces on only one longitudinal edge provides a multiplicity of slide fasteners of individual length, yet without involving any risk of erroneous severing across fabric pieces leading to damaging of the products.

However, in attaching slide fasteners to such articles as garments like one-piece dresses, blanket covers, fabric sacks and fabric bags, two successions of fabric pieces composing such articles mentioned above must be sewn one to each longitudinal marginal edge of a slide fastener chain; and then the slide fastener chain is severed laterally across the gap portions. However, this operation suffers from a problem. Fabric pieces to be sewn to the slide fastener chain are not necessarily formed uniform in length. The longer are fabric pieces to be used, the more do they vary in length from each other, naturally. Besides, the operation of sewing fabric pieces to a slide fastener chain is carried out at very high rate for enhancement of production efficiency. With such high-speed operation, fabric pieces are not necessarily sewn to the opposed longitudinal edges of the slide fastener at right positions or with the opposed mating fabric pieces laterally in registry. This means that the opposed mating gap portions interposed therebetween are liable to become out of alignment with each other. The severing of the slide fastener chain across one gap portion under this condition would objectionably cut across the fabric piece, instead of gap portions.

SUMMARY OF THE INVENTION

With the foregong difficulties in view, it is therefore, an object of the present invention to provide an apparatus for automatically severing a slide fastener chain having a succession of fabric pieces attached to each of the opposed longitudinal marginal edges thereof laterally across opposed mating gap portions, thus being completely free from damaging the fabric pieces.

According to one aspect of the present invention, there is provided an apparatus for automatically severing a continuous slide fastener having a succession of fabric pieces attached to each of the opposed longitudinal marginal edges with a gap portion interposed between each adjacent pair of fabric pieces comprising:

(a) a feeding unit for feeding the fabric-pieced slide fastener chain longitudinally along a feeding path;

(b) a cutting unit disposed on the feeding path for severing the fabric-pieced slide fastener chain transversely across the gap portions;

(c) detecting means disposed on the feeding path immediately upstream of the cutting unit for producing a signal only when laterally-aligned gap portions reach the detecting means;

(d) the detecting means, feeding unit and the cutting unit are electrically connected such that, upon receipt of the signal from the detecting means, the feeding unit is deenergized and at the same time the cutting unit is energized.

According to another aspect of the present invention, there is provided an apparatus for automatically severing a continuous slide fastener chain having a succession of fabric pieces attached to each of the opposed longitudinal marginal edges with a gap portion interposed between each adjacent pair of fabric pieces comprising:

(a) a feeding unit for feeding the fabric-pieced slide fastener chain longitudinal along a feed path;

(b) a cutting unit disposed on the feed path for severing the fabric-pieced slide fastener chain transversely across the gap portions;

(c) detecting means disposed on the feed path a predetermined distance upstream of the cutting unit for producing a signal only when laterally-aligned gap portions reach the detecting means;

(d) measuring unit disposed on the path for, upon receiving the signal from the detecting means producing a signal, depending on the amount of the fabric-pieced fastener chain having been fed through the measuring unit;

(e) a control unit electrically connected with the detecting means and the measuring unit for, upon receipt of a signal from the detecting means, measuring the signal having been issued from the measuring unit, and for producing an output signal, when the amount of the signal reaches a predetermined value corresponding to the predetermined distance, to deenergize the feeding unit and at the same time to energize the cutting unit.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Some preferred embodiments of this invention are described hereinbelow in conjunction with the drawings attached hereto.

Figure 1:
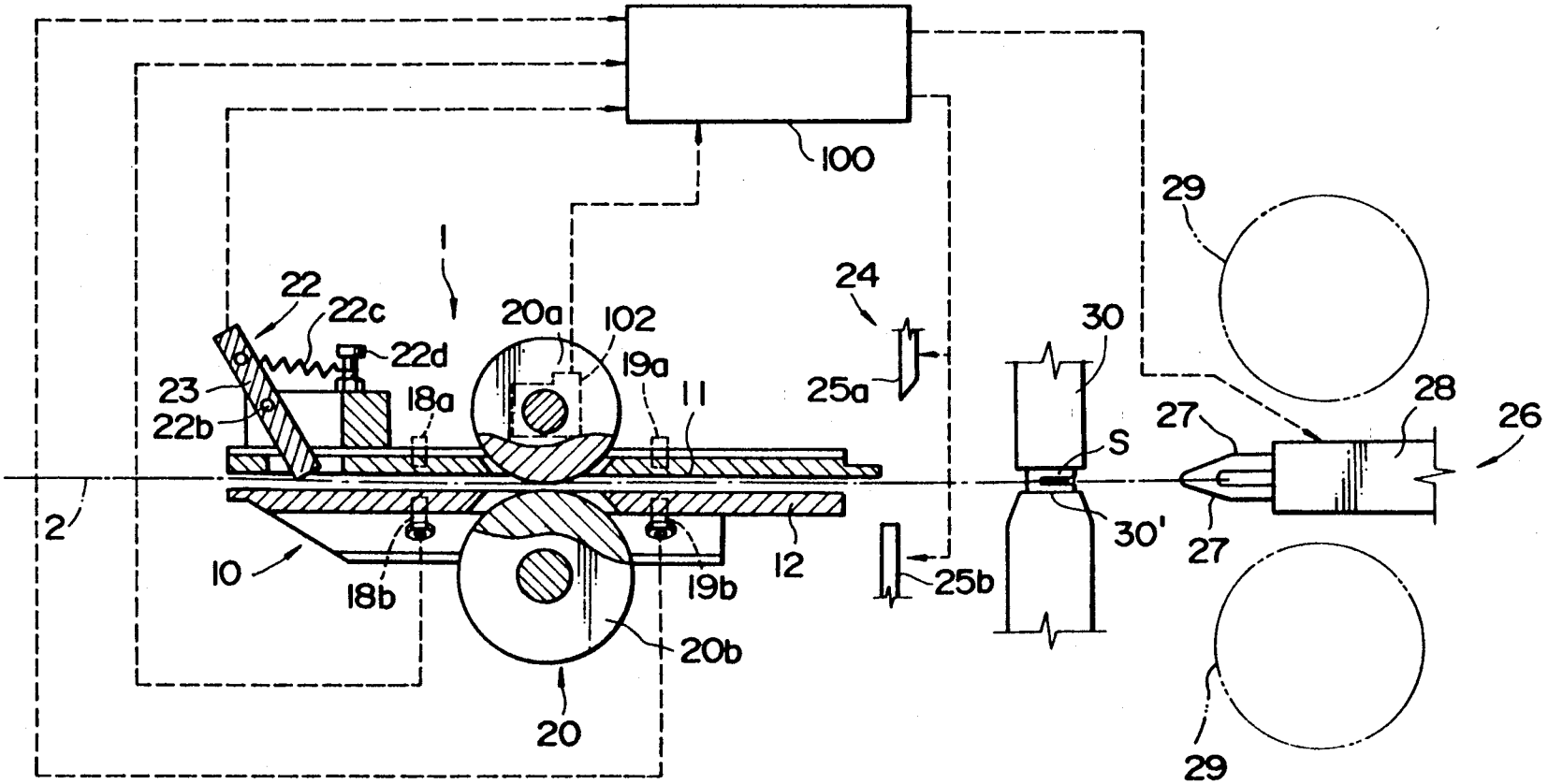
FIG. 1 is a diagramatical, fragmentary, front elevational view, partly cross-sectional, of an apparatus according to the present invention.

FIG. 1 diagramatically shows an apparatus for automatically severing a slide fastener chain 3 having a succession of fabric pieces 4, 4, attached to each of the opposed longitudinal marginal edges Tb, Tb thereof to a multiplicity of slide fasteners of an individual length.

The apparatus broadly comprises a detecting station 1, a cutting unit 24 and a feeding unit 26 along a path of feeding the slide fastener chain 3, as viewed from upstream to downstream in FIG. 1.

Figure 4:
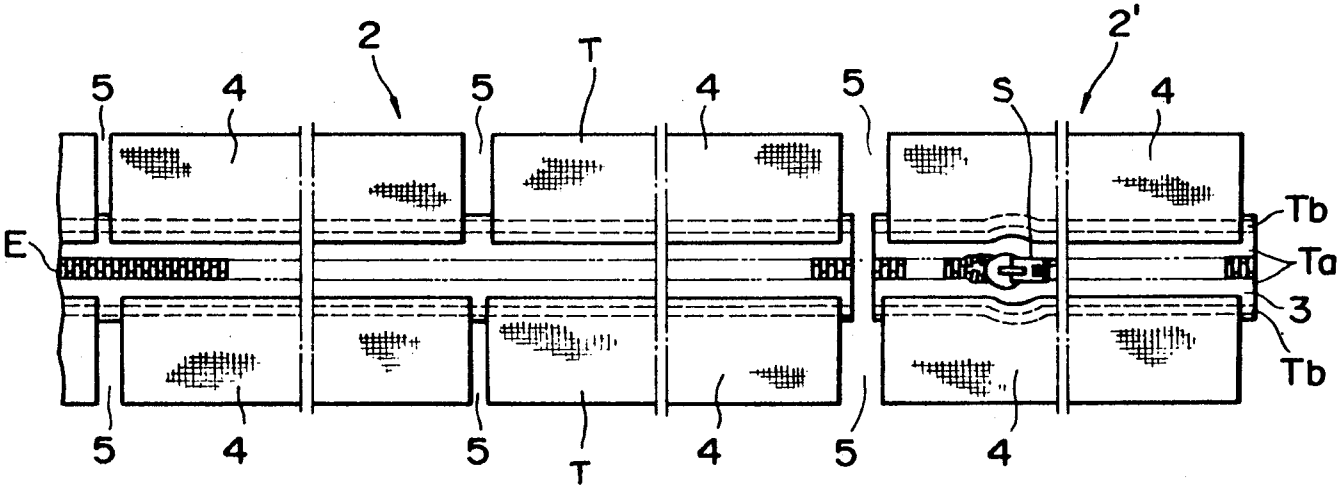
FIG. 4 is a fragmentary plan view of a continuous length of a slide fastener chain having a succession of fabric pieces attached to each of the opposed longitudinal marginal edges.

FIG. 4 shows a slide fastener chain 3 having a succession of fabric pieces 4 of a predetermined individual length sewn along each of the opposed longitudinal marginal edge portions Tb, Tb. The slide fastener chain 3 comprises a pair of continuous slide fastener stringers comprising a pair of continuous fastener tapes T, T and two continuous coupled fastener element rows E, E mounted on and along the opposed longitudinal edges Ta, Ta of the tapes T, T. The fabric-pieced slide fastener chain will be noted by reference numeral 2 hereinafter, as distinguished from a slide fastener chain proper denoted by reference numeral 3. These fabric pieces 4, 4 are component parts of garments, fabric sacks, fabric bags, blanket covers or the like articles. These fabric pieces 4, 4 are sewn to the slide fastener chain 3 along its opposed longitudinal marginal edges Tb, Tb with gap portions 5, 5 interposed between each adjacent fabric pieces 4, 4. As such opposed mating gap portions 5, 5 are generally in lateral alignment with each other, the continuous fabric-pieced slide fastener chain 2 are severed laterally across the gap portions 5, 5, at the cutting unit 24, to thus provide a plurality of fabric-pieced slide fasteners 2' of a predetermined individual length, as shown in FIG. 4.

Refering to FIG. 1, reference numeral 10 denotes a guide means for guiding the fabric-pieced slide fastener chain 2 at the detecting station 1 while the fabric-pieced slide fastener chain 2 is fed along the feeding path.

Figure 2:
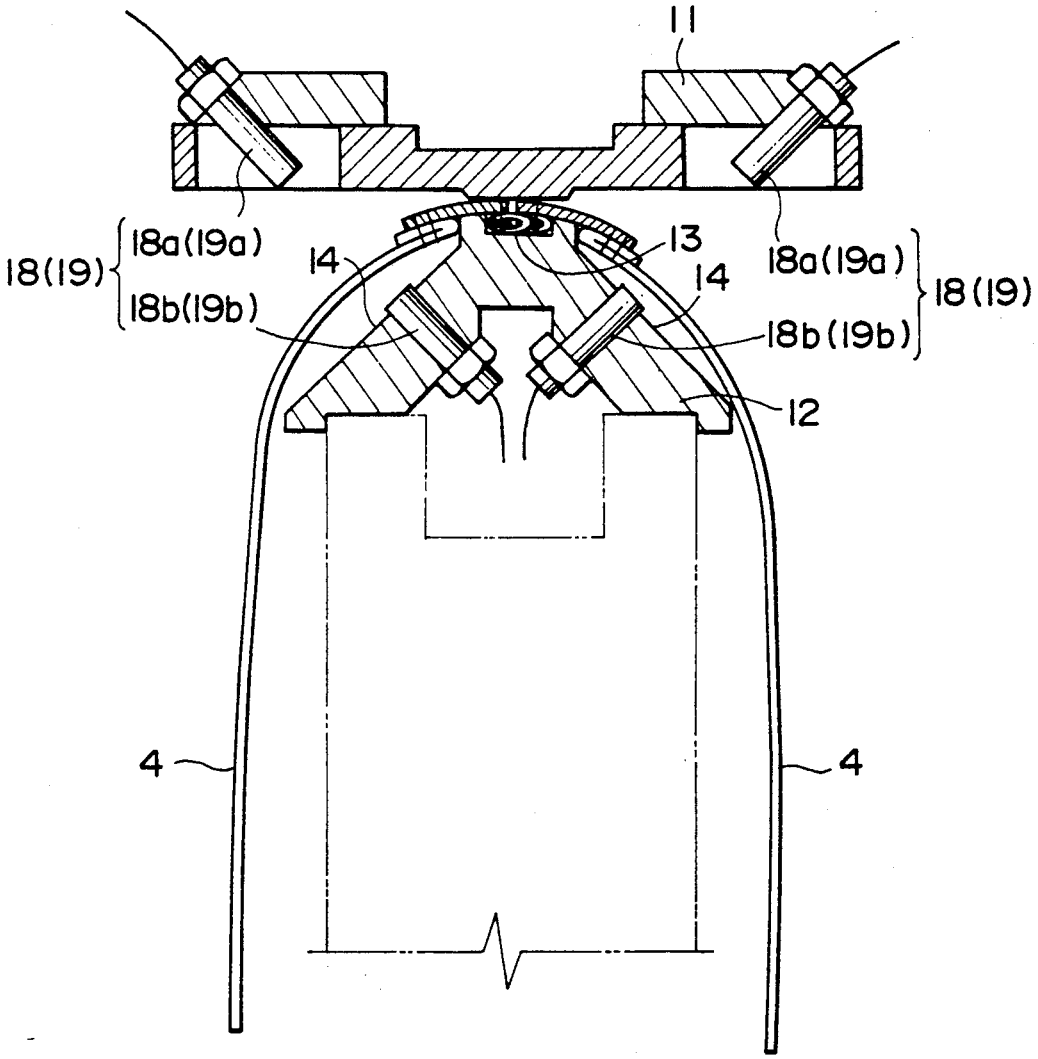
FIG. 2 is a cross-sectional view of a guide means of the apparatus of FIG. 1.

As shown in FIGS. 1 and 2, the guide means 10 comprises an upper guide plate 11 and a lower guide block 12 disposed beneath the upper guide plate 11 to coact the upper guide plate 11 in guiding the fabric-pieced slide fastener chain 2 therebetween. The fabric-pieced slide fastener chain 2 is guided along between the upper guide plate 11 and the lower guide block 12. As best shown in FIG. 2, the lower guide block 12 is of a trapezoidal cross-section, whose opposed slanting lateral sides 14, 14 converse toward the top side. This cross-section permits the fabric-pieced slide fastener chain 2 to be guided on the guide block 12 with the opposed fabric pieces 4, 4, hanging downward along the opposed lateral sides 14, 14 thereof by their own gravity. The lower guide block 12 has at its top side an elongated guide groove 13 which extends throughout the full length of the guide block 12 and which is complementary in cross-section with the coupled fastener element rows E, E. The coupled fastener element rows E, E of the slide fastener chain 3 fit in the guide groove 13 as the fabric-pieced slide fastener chain 2 is guided on the guide block 12. This ensures stable feeding of the fabric-pieced slide fastener chain 2. With the guide means 1 constructed as above, even if the fabric pieces 4, sewn to the opposed longitudinal edges of the slide fastener chain 3 are bulky or considerably large, the fabric-pieced slide fastener chain 2 may be fed to the succeeding cutting unit 24, with the opposed fabric pieces 4, 4 conveniently hanging downward, without occupying any space laterally of the feeding path, so that the fabric-pieced slide fastener chain 2 may be severed accurately across the opposed mating gap portions 5, 5, between each adjacent fabric pieces 4, 4.

Disposed in succession along the elongated guide means 10—from upstream to downstream—are a chain-sensing means 22, a first detecting means 18, a measuring unit 20 and a second detecting means 19, which all makes up the detecting station 1.

The chain-sensing means 22 comprises a sensor body 22*a* and a sensor lever 23 pivotally mounted at its middle on a pin 22*b* secured to one side of the sensor body 22*a*. The sensor lever 23 is inclined downward downstream. A tension spring 22*c* links the upper end of the sensor lever 23 and a bolt 22*d* provided on the top of the sensor body 22*a* so as to normally bias the sensor lever 23 clockwise so that the lower end of the sensor lever 23 is normally urged in abutting engagement with the upper surface of the fabric-pieced slide fastener chain 2. When the fabric-pieced slide fastener chain 2 fails to be fed due to voluntary discontinuation of production or accidental breakage of the fabric-pieced slide fastener chain 2, the sensing lever 23 rotates slightly clockwise on the pin 22*b* under the bias of the tension spring 22*c*, to thus sense the absence of the fabric-pieced slide fastener chain 2 on the feeding path, thereby deenergizing a drive means (not shown) of the feeding unit 26 and deenergizing a drive means (not shown) of the cutting unit 24 through a control unit 100. Besides, the sensor lever 23 being inclined downward downstream advantageously prevents the tendency of the fabric-pieced slide fastener chain 2 moving backward; namely, when the fabric-pieced slide fastener chain 2 accidentally moves backward or against the direction of feeding, the lower end of the sense lever 23 sticks to an inter-element-space between any adjacent fastener elements, thus advantageously preventing the fabric-pieced slide fastener chain 2 from moving further backward.

Figure 3:
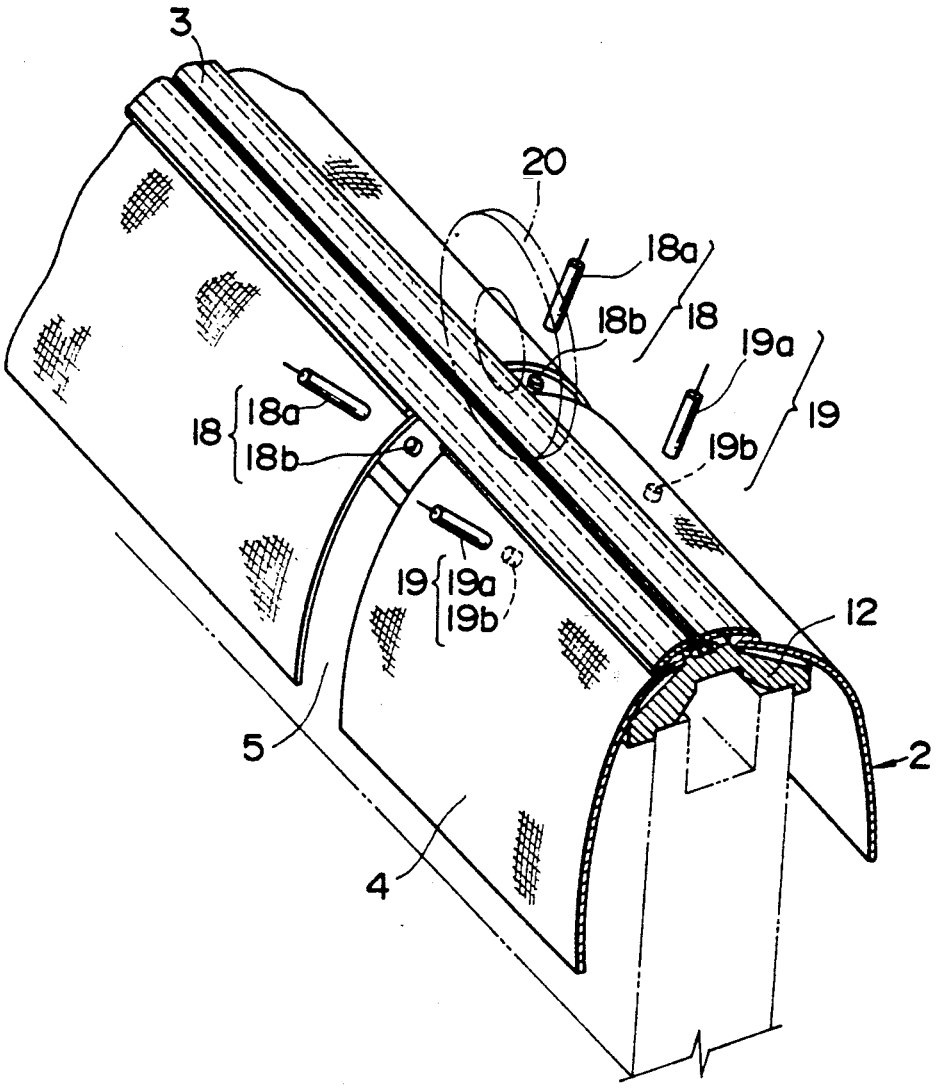
FIG. 3 is a fragmentatary prespective view of a detecting station.

As better shown in FIGS. 2 and 3, a pair of first detectors as the first detecting means 18 are disposed one on each side of the guide groove 13 and in lateral alignment with each other. Each of the first detectors comprises a light-emitting component 18*a* such as a light-emitting diode mounted on the guide plate 11 so as to be disposed on one or the outer side of a feed path of the fabric pieces 4 and a photo detector 18*b* such as a photo diode mounted on the corresponding slant side 14 of the guide block 12 so as to be disposed on the opposite or inner side of the feed path of the fabric pieces 4, the light-emitting component 18*a* and the photo detector 18*b* facing each other for the latter's receiving the former's light beam, as shown in FIG. 2. The light-emitting components 18*a* and the photo detectors 18*b* are so arranged such that, only when both photo detectors 18*b*, 18*b* receive light beams from the respective light-emitting component 18*a*, 18*a* through the opposed gap portions 5, 5, the photo detectors 18*b*, 18*b* generate a signal. Otherwise, that is, when only one photo detector 18*b* receives a light beam, then the photo detector 18*b* will not generate a signal.

As better shown in FIG. 1, the measuring unit 20 is positioned immediately upstream of the first detecting means 18 and comprises a pair of idle rollers 20*a*, 20*b* whose axes are vertically spaced apart from and parallel with each other across the feed path of the slide fastener chain 3. The idle rollers 20*a*, 20*b* are corotatable with the fabric-piece slide fastener chain 2 held therebetween as the fabric-pieced slide fastener chain 2 is fed by the feed unit 26. Either one of the idle roller 20*a*—the idle roller 20*a* as shown in FIG. 1—is provided with an encorder 102 which produces pulse signals in response to the rotation of the idle roller 20*a*

As shown in FIG. 1, another pair of second detectors as the second detecting means 19 is disposed immediately downstream of the measuring unit 20. Since the second detecting means 19 is substantially identical in construction, arrangement and the manner to generate a signal with the first detecting means 18, as shown in FIG. 2, any further description thereabout is omitted for brevity's sake.

A cutting unit 24 is disposed immediately downstream of the downstream end of the guide means 10 on the feed path of the fabric-pieced slide fastener chain 2. The cutting unit 24 comprises a pair of upper and lower cutting blades 25*a*, 25*b* disposed one one each side of the feed path of the fabric-pieced slide fastener chain 2. The upper and lower cutting blades 25*a*, 25*b* are vertically reciprocable toward and away from each other by any suitable drive means (not shown) like an air cylinder to sever the fabric-pieced slide fastener chain 2 transversely across the gap portions 5, 5.

Disposed most downstream is the feed unit 26, as shown in FIG. 1. The feed unit 26 comprises a feed unit body 28 which is reciprocable, by any suitable drive means (not shown), back and forth along the feed path of the fabric-pieced slide fastener chain 2 to feed the fabric-pieced slide fastener chain 2 along the feed path. A pair of gripping jaws 27, 27 are mounted on the distal end of the feed unit body 28 and are adapted to spread and close to release and grip the fore end of the fabric-pieced slide fastener chain 2. With the construction, the gripping jaws 27, 27 grip the leading end of the slide fastener chain 3 and, after feeding of the fabric-pieced slide fastener chain 2 and severing thereof into an individual length slide fastener 2', spread apart to release the individual length slide fastener 2' so as to withdraw the individual length slide fastener 2' from the apparatus.

As indicated in phantom lines in FIG. 1, a pair of withdrawal rollers 29, 29 may be disposed one on each side of the feed unit 26 so as to be vertically reciprocable toward and away from each other to hold the fabric-pieced slide fastener chain 2 therebetween. These rollers 26, 26 are very helpful in withdrawing the slide fastener chain 3 having considerably long fabric pieces 4, 4, attached to its opposed longitudinal edges Tb, Tb. After the leading end of the slide fastener chain 2 is fed past the withdrawal rollers 29, 29 by the feeding unit 26, the withdrawal rollers 29, 29 move toward each other to thus clamp the fabric-pieced slide fastener chain 2 therebetween. Thereafter, the gripping jaws 27, 27 spread apart to release the leading end of the fabric-pieced slide fastener chain 2. The withdrawal rollers 29, 29 rotate to withdraw the fabric-pieced individual length slide fastener 2'.

With the construction of the apparatus mentioned above, the apparatus operates as follows.

Figure 5A:
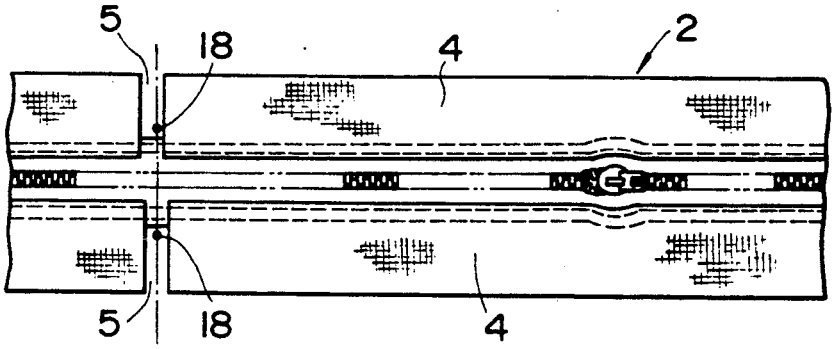
FIGS. 5(A), (B) and (C) are fragmentary plan views of the continuous length of the slide fastener chain, showing the chain being subjected to consequential steps of detection and severing.
Figure 5B:
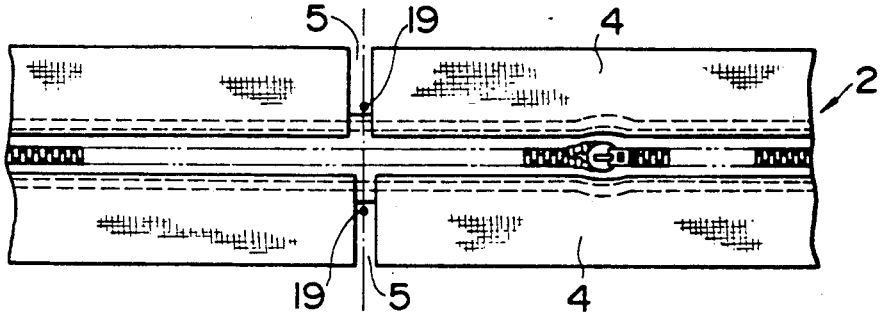
Figure 5C:
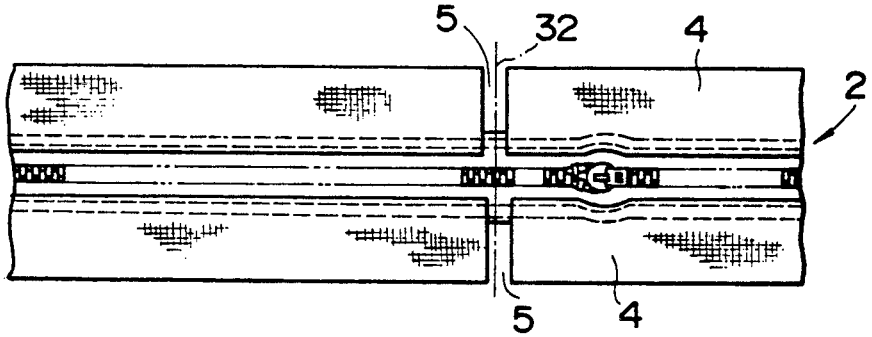

The fabric-pieced slide fastener chain 2 is fed along the feed path. When the laterally-aligned gap portions 5, 5 reach the first detecting means 18, as shown in FIG. 5(A), both photo detectors 18*b*, 18*b* receive light beams from the light-emitting components 18*a*, 18*a* through the laterally-aligned gap portions 5, 5. Immediately, the photo detectors 18*b*, 18*b* generate a signal and transmit it to the drive means for the feeding unit 26 through the control unit 100 so as to change the feeding speed from high rate to low rate. The change of the feeding speed to low rate is intended to ensure reliable measuring of the measuring unit 20 and accurate detection of the second detecting means 19 downstream, as closely described hereinafter. When the laterally-aligned gap portions 5, 5 reach the second detecting means 19 as shown in FIG. 5(B), both photo detectors 19*b*, 19*b*, likewise, receive light beams from the light-emitting components 19*a*, 19*a* through the laterally-aligned gap portions 5, 5. Immediately, the photo detectors 19*b*, 19*b* of the second detecting means 19 generate a signal and transmit it to the encorder 102 of the idle roller 20*a* of the measuring unit 20 through the control unit 100, to thus actuate the encorder 102 to generate a pulse signal every rotation of the idle roller 20*a* and to transmit the pulse signal to the control unit 100. The control unit 100 measures the number of the pulse signals. When the number of the pulse signals reaches a predetermined value corresponding to the distance between the cutting unit 24 and the second detecting means 19, the control unit 100 transmits a signal to the drive means for the feeding unit 26 to the deenergize it for stopping the feed of the fabric-pieced slide fastener chain 2 and at the same time to the drive means for the cutting unit 24 to energize it for moving the upper and lower blades 25*a*, 25*b* toward each other to sever the fabric-pieced slide fastener chain 2 along a cutting line 32 running across the laterally aligned gap portions 5, 5 as shown in FIG. 5(C).

Figure 6:
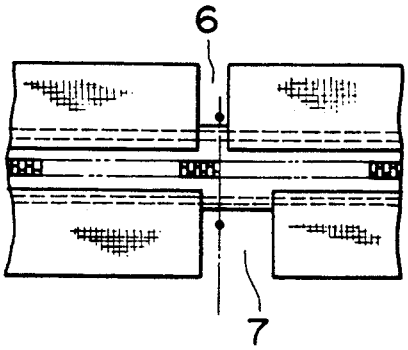
FIG. 6 is a fragmentary plan view of the continuous slide fastener chain, showing opposed mating gap portions being partly aligned with each other.

FIG. 6 shows opposed mating gap portions 6, 7 being laterally aligned in part with each other; to be specific, although the trailing ends of the preceding opposed fabric pieces 4, 4 are not aligned, the leading ends of ensuing opposed fabric pieces 4, 4 are aligned with each other. As long as the opposed mating gap portions 6, 7 are laterally aligned even in part with each other, the photo detectors 18*b*, 18*b*; 19*b*, 19*b* receive light beams from the light-emitting components 18*a*, 18*a*; 19*a*, 19*a*, respectively, so that the retardation of the fabric-pieced slide fastener chain 2 and the cutting of the fabric-pieced slide fastener chain 2 laterally across the opposed gap portions 6, 7 can be carried out as mentioned above.

Figure 7:
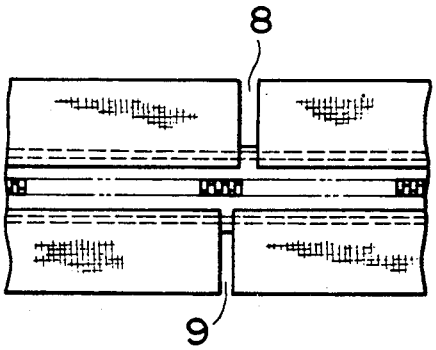
FIG. 7 is a view similar to FIG. 6, but showing the opposed mating gap portions being completely out of alignment with each other.

On the other hand, FIG. 7 shows opposed mating gap portions 8, 9 being completely out of lateral alignment. Since, upon arrival of either of the gap portions 8, 9 at the detecting means 18, 19, both mating photo detectors 18*b*, 18*b*; 19*b*, 19*b* of each detecting means 18, 19 do not receive light beams at the same time, no photo detectors 18*b*, 18*b*; 19*b*, 19*b* will generate a signal, so that the non-aligned gap portions 8, 9 of the fabric-pieced slide fastener chain 2 is fed past the cutting unit 24 without being subjected to retardation and cutting operation. The non-aligned gap portions 8, 9 which has not been cut in the cutting unit 24 will be cut by hands, so that fabric pieces 4, 4 are quite immune from being damaged by the cutting blades 25*a* and 25*b* of the cutting unit 25.

As shown in FIG. 1, a slider holder 30 is provided on the feed path between the cutting unit 24 and the feeding unit 26. The slider holder 30 functions to hold sliders S one after another on its sldier mount 30' which is level with the feed path of the slide fastener chain 3. Two rows of fastener elements E, E are threaded through sliders S mounted on the slider mount 30' as the fabric-pieced slide fastener chain 2 is fed along the feed path by the gripping jaws 27, 27 of the feeding unit 26. The slider holder 30 may be of the type commonly used in this circle, and so any further explanation is omitted here. It is to be noted that, although the apparatus according to the present invention is shown in FIG. 1 to include a slider holder 30, it may be dispensed with. In this event, sliders S are manually installed on thus produced individual slide fasteners with a fabric pieced attached thereto.

Although not shown in the drawings, a bottom-end-stop-applying means as commonly used in this circle may be provided between the slider holder 30 and the feeding unit 26 for attaching bottom end stops one after another adjacent to leading end of each individual length slide fastener-to-be.

In the preceding embodiment, the first detecting means 18 comprises a pair of first detectors disposed one on each side of the path of the slide fastener chain 3 for detecting opposed mating gap portions 5, 5. Thus retarding the feed of the fabric-pieced slide fastener chain 2. However, since the first detecting means 18 only functions to retard the feed of the fabric-pieced slide fastener chain 2, the first detecting means 18 may comprise only one detector—instead of a pair of detectors—disposed on either side of the path of the slide fastener chain 3, for detecting gap portions 5 on only one longitudinal edge of the slide fastener chain 3. In this embodiment, when the cutting unit 24 is not energized by the second detecting means 19 failing to detect any laterally-aligned gap portions 5, 5, the retardation spurred by the first detecting means 18 may be undone by changing the feed speed from the low rate to high rate once again.

Figure 8:
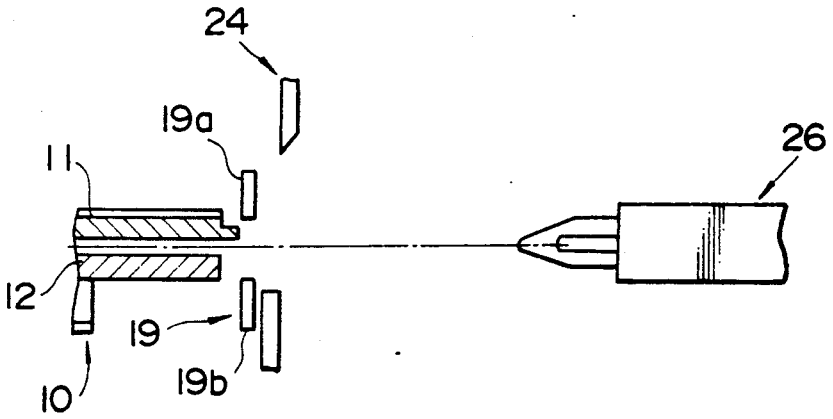
FIG. 8 is a view similar to FIG. 1, but showing a modified embodiment of the present invention.

FIG. 8 shows another embodiment in which the second detecting means 19 is positioned immediately upstream of the cutting unit 24. Upon detecting the laterally-aligned gap portions 5, 5, the second detecting means 19 generates and transmits a signal to the feeding unit 26 and the cutting unit 24 through the control unit 100, to deenergize the feeding unit 26 and energize the cutting unit 24, respectively, so that the the fabric-pieced slide fastener chain 2 discontinues to be fed and at the same time the fabric-pieced slide fastener chain 2 is severed across the laterally-aligned gap portions 5, 5. In this embodiment, the measuring unit 20 can be dispensed with.

Where the speed of the fabric-pieced slide fastener chain 2 being fed is within the range permitting the second detecting means 19 to accurately detect laterally-aligned gap portions 5, 5 downstream, the first detecting means 18 may be omitted.

In the preceding embodiment, opto electronic devices are used as the first and second detecting means 18, 19. Alternatively, limit switches or proximity switches may be used for the purpose described hereinbefore.

With the apparatus of the construction as mentioned above, the fabric-pieced slide fastener chain 2 can be severed laterally across laterally-aligned gap portions 5, 5, while non-aligned gap portions 8, 9, are let to pass by without severing made thereacross, so that high-quality slide fasteners 2' having fabric pieces 4, 4, of a predetermined individual length attached thereto can be manufactured and there is no danger of the fabric pieces 4, 4, being damaged by the cutting unit 24.

Obviously, various modifications and variations of the present invention are possible in the light of the above teaching. It is therefore to be understood that within the scope of the appended claims the invention may be practiced otherwise than as specifically described.

What is claimed is:

1. An apparatus for automatically severing a continuous slide fastener chain having a succession of fabric pieces attached to respective opposed longitudinal marginal edges with a respective gap portion interposed between each adjacent pair of fabric pieces comprising:

(a) a feeding unit for feeding the fabric-pieced slide fastener chain longitudinally along a feeding path;

(b) a cutting unit disposed on the feeding path for severing the fabric-pieced slide fastener chain traversely across the gap portions; and (c) detecting means disposed on the feeding path immediately upstream of the cutting unit for producing a signal only when laterally-aligned gap portions reach the detecting means while not producing a signal when only one gap portion reaches the detecting means;

(d) the detecting means, the feeding unit, and the cutting unit being electrically connected such that, upon receipt of the signal from the detecting means, the feeding unit is deenergized and at the same time the cutting unit is energized.

2. An apparatus for automatically severing a continuous slide fastener chain having a succession of fabric pieces attached to respective opposed longitudinal marginal edges with a respective gap portion interposed between each adjacent pair of fabric pieces comprising:

(a) a feeding unit for feeding the fabric-pieced slide fastener chain longitudinal along a feed path;

(b) a cutting unit disposed on the feed path for severing the fabric-pieced slide fastener chain transversely across the gap portions;

(c) detecting means disposed on the feed path a predetermined distance upstream of the cutting unit for producing a signal only when laterally-aligned gap portions reach the detecting means while not producing a signal when only one gap portion reaches the detecting means;

(d) measuring unit disposed on the path for, upon receiving the signal from the detecting means, producing a signal, depending on the amount of the fabric-pieced fastener chain having been fed through the measuring unit; and (e) a control unit electrically connected with the detecting means and the measuring unit for, upon receipt of a signal from the detecting means, measuring the signal having been issued from the measuring unit, and for producing an output signal, when the amount of the signal reaches a predetermined value corresponding to the predetermined distance, to deenergize the feeding unit and at the same time to energize the cutting unit.

3. An apparatus according to claim 2, the measuring unit comprising a pair of idle rollers which are corotatable as the fabric-pieced slide fastener chain is fed by the feeding unit, either one of the idle rollers being provided with an encorder which produces a number of the electrical signals depending on the number of rotation of said one idle roller.

4. An apparatus according to claim 2, the detecting means comprising a pair of light-emitting components being disposed one on opposite sides of the feed path of the slide fastener chain and in lateral alignment with each other, each of the light-emitting components being positioned on one side of the path of the relevant fabric pieces; and a pair of photo detectors being disposed on one on each side of the path of the slide fastener chain and in lateral alignment with each other; each of the photo detectors being positioned on the other side of the path of the relevant fabric pieces for receiving a light beam from a respective light-emitting component through the respective gap portions.

5. An apparatus according to claim 2, further including another detecting means disposed on the feed path upstream of the first-mentioned detecting means for producing a signal only when the laterally-aligned gap portions reach the second-mentioned detecting means; the control unit further electrically connected to the second-mentioned detecting means for, upon receipt of the signal from the second-mentioned detecting means, producing an output signal to the feeding unit to change the feeding speed of the fabric-pieced slide fastener chain from high rate to low rate.

6. An apparatus according to claim 5, the second-mentioned detecting means comprising a light-emitting component disposed on at least one side of the feed path of the slide fastener chain and positioned on one side of the path of fabric pieces and a photo detector disposed on said one side of the feed path of the slide faseneer chain and positioned on the other side of the path of fabric pieces for receiving a light beam from said light-emitting component through the gap portions.

* * * * *